United States Patent [19]

Connolly

[11] Patent Number: 4,675,974

[45] Date of Patent: Jun. 30, 1987

[54] METHOD OF CONTINUOUS CASTING AND ROLLING STRIP

[75] Inventor: Richard S. Connolly, Pittsburgh, Pa.

[73] Assignee: Tippins Machinery Co., Inc., Pittsburgh, Pa.

[21] Appl. No.: 788,498

[22] Filed: Oct. 17, 1985

[51] Int. Cl.[4] ..... B21B 1/46; B21B 41/02; B22D 11/12

[52] U.S. Cl. ..... 29/527.7; 72/200; 72/203; 72/229; 164/476

[58] Field of Search ..... 164/476, 417; 29/527.7; 72/202, 200, 201, 203, 229

[56] References Cited

U.S. PATENT DOCUMENTS

| | | | |
|---|---|---|---|
| 4,005,744 | 2/1977 | Cofer et al. . | |
| 4,051,887 | 10/1977 | Groth et al. | 164/476 |
| 4,232,727 | 11/1980 | Bower et al. . | |
| 4,384,468 | 5/1983 | Ginzburg | 72/202 |
| 4,420,029 | 12/1983 | Kameyama et al. | 164/417 X |
| 4,430,874 | 2/1984 | Tippins et al. | 72/202 |

FOREIGN PATENT DOCUMENTS

| | | | |
|---|---|---|---|
| 45-415 | 1/1970 | Japan | 72/202 |
| 56-74304 | 6/1981 | Japan | 72/202 |
| 60-17015 | 1/1985 | Japan | 72/202 |

*Primary Examiner*—J. Reed Batten, Jr.

*Attorney, Agent, or Firm*—Webb, Burden, Robinson & Webb

[57] ABSTRACT

A method and plant for casting and rolling strip and/or sheet in line. The method comprises continuously casting slabs less than about 1.5 inches thick which naturally have a columnar grain structure. The method further comprises passing the slabs directly onto an insulated run-out table for maintaining temperature and minimizing heat loss from the slabs and permitting equalization of temperature within the slabs. The method also comprises passing the slabs directly to a hot reversing mill having upstream and downstream coiling furnaces such that the slabs first pass the reversing mill and are subject to an initial reduction in thickness sufficient to break up the columnar structure prior to being coiled as strips in the downstream coiling furnace and passing the strips back and forth to produce sheet or strip having an equiaxed grain structure.

10 Claims, 2 Drawing Figures

METHOD OF CONTINUOUS CASTING AND ROLLING STRIP

DESCRIPTION

Background

Sheet and strip products have heretofore been produced in large mills by ingot casting or continuous casting of thick slabs, say 8–10 inches thick, which slabs must be subsequently processed through a hot strip mill comprising reheat furnaces and a rolling mill having roughing and finishing trains. The treatment and handling of the slabs in reheat furnaces is a costly but essential step in the process.

There has been a trend in recent years to establish so-called "mini mills" or "mini-midi mills". These are mills that typically produce 100,000 to 1,000,000 tons of steel per year of specialized products. These mills have been integrated with continuous casters for casting small billets, bars, and rods. However, the integration of slab casters and mini mills has not extended to the reduction of slabs to strip thicknesses because of the large capital investment required for heating and rolling equipment and the floor space requirements.

This invention relates to an integrated process for the casting and rolling of slabs to form strip and/or sheet. It is particularly applicable to the small steel mill where finances and space are limited. In this process, rolling may take place in a single stand reversing mill rather than a continuous or semi-continuous hot strip mill. It involves the use of continuously cast thin slabs, say on the order of 1.5 inches thick or less. It eliminates the use of reheat furnaces and large roughing mills altogether.

It has been reported that increasingly thinner sections have been cast with present capability limited to about 1 inch thickness, *Iron and Steel Engineering,* February 1984, p. 47. This article states that government sponsored research has been directed to ultimately casting strip at or near final thickness. However, in the near future, the applicant's approach to thin slab casting and hot rolling almost directly as the slab emerges from the caster has much greater potential.

SUMMARY OF THE INVENTION

Briefly, according to this invention, there is provided a method for casting and rolling steel or other metal strip and/or sheet. The method comprises a first step of continuously casting a thin slab. A second step comprises equalizing and retaining the temperature of the continuously cast slab prior to reduction. The second step is performed in an insulated run-out table or furnace-like structure which is somewhat longer than the slab. A third step comprises cutting the slab to a desired length with a flying shear. A fourth step comprises rolling the slab to strip, for example, by passing it back and forth through a reversing mill between an upstream coiling furnace and a downstream coiling furnace. It shoud be noted that more than one step may be going on simultaneously. It is essential, according to this invention, that the slab is not coiled until after its first reduction during which its grain structure is made less columnar and more equiaxed. Preferably, the initial reduction of the slab is about 50 percent to assure at least partial breakdown of the columnar grain structure. A final step comprises recovering and coiling the strip or stacking the sheet.

According to a preferred embodiment, a step is provided for passing the strip, which has been hot rolled to the desired gauge, over a run-out table where cooling jets bear upon it and then passing the strip to the final coiler.

Also, according to this invention, there is provided a plant for rolling steel strip and/or sheet. The plant comprises an apparatus for melting steel and apparatus for continuous casting slabs having a thickness, say on the order of 1.5 inches or less. The plant includes an insulated run-out table or furnace-like structure for receiving the cast slabs directly from the caster to retain temperature and reduce the difference in temperature from the interior to the faces of the slabs and minimize the difference in temperature from the head to the tail of the slab. The plant comprises a rolling mill downstream of the insulated run-out table. Most preferably the rolling comprises a reversing mill having coiling furnaces positioned upstream and downstream of the mill. The rolling time for the reversing mill must be substantially less than the time for casting a slab. The slab is typically reduced to strip thickness in 7, 5 or 3 passes through the reversing mill.

The insulated run-out table or furnace-like structure must have driven rollers for supporting the slab. It is essential that groups of rollers be individually controllable and at variable tangential speeds from the casting speed (about ten feet per minute) to the suck-in speed of the rolling mill (say, 300 feet per minute) for a rolling speed of 600 feet per minute and a 50 percent reduction. Since a slab being cast and slabs being sucked into the mill may both be on the insulated run-out table at the same time, the speeds of the rollers (or groups of rollers) must be individually controllable. Thus, immediately after the tail portion of the slab being sucked into the rolling mill has passed a roller on the run-out table, its tangential velocity should drop from the suck-in speed to the casting speed.

It is an established fact that continuously cast steel of any type has a columnar grain structure after casting. Such a structure resists bending and coiling. Intergranular tearing can even take place when columnar steel is bent. It is possible to reduce the columnar grain structure to an equiaxed grain structure by a proper draft in the first pass of the rolling mill. It is an advantage according to this invention that the columnar grain structure is broken up sufficiently before bending or coiling of the slab to avoid damage to the slab. It is a further advantage to achieve an optimized equiaxed grain structure after the final pass through the rolling mill. Both these effects are controlled by the recrystallization phenomenon which is well known for all metals of interest.

DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
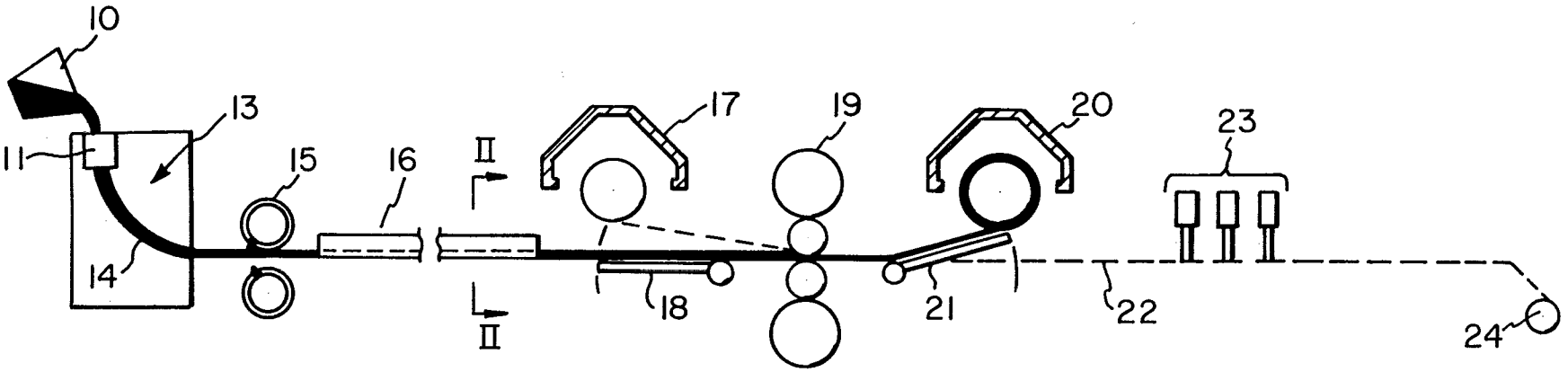
FIG. 1 is a schematic of a plant for continuously casting and rolling slabs to strip.

Referring now to FIG. 1, hot metal is transferred from the furnace, for example, an electric furnace (not shown) by a transfer ladle 10 to the tundish 11 of a continuous casting apparatus, caster 13. While the invention has particular application to steel, it may likewise be used for other metals. The steel solidifies into a continuous slab as it passes through the water cooled curved mold 14. As the steel passes through the caster, the direction is changed from vertical to horizontal, although horizontal casters are known and can also be employed. In practice, for thin slabs, a water cooled belt caster is employed. The machine is sized so that the slab emerges from the caster having a thickness less than 2.0 inches and preferably less than about 1.5 inches and a width of up to 72 inches. The length and cast thickness of a slab determines the coiled pounds per inch width (PIW) capability. For example, a 1.5 inch slab 100 feet long has a 560 PIW capability and a 1.5 inch slab 150 feet long has a 764 PIW capability. The specific slab referred to hereafter is 1.5 inches thick by 50 inches wide by 175 feet long. The slab is cut to length by a flying shear 15 when it reaches the desired length. By this time the slab is entirely solidified and there is no liquid center. The continuous slab emerges at an approximate rate of 10 to 12 feet per minute (approximately 90 U.S. tons per hour). The details of the continuous slab caster and the flying shear are known and form no part of this invention.

The continuous slab immediately passes into an insulated run-out table or furnace-like structure 16 which is for the purpose of maintaining heat and equalizing the temperature between the interior and faces of the slabs, i.e. homogenizing the temperature of the slab even though the slab is being produced at the typically slow casting speed. The furnace-like structure 16 may or may not be equipped to add heat to the slab. The term furnace-like structure or insulated run-out table is employed herein to describe this structure. Since the slab is so thin as compared to the standard cast slab, the rate of heat loss is substantially higher. In addition, because of the relatively slow casting time, the total time for heat loss to occur is high. The furnace-like structure, which is insulated or reflective and of a box or tunnel shape, maintains the heat.

Preferably the furnace-like structure 16 is in excess of 100 feet long, say up to 200 feet long. It is most desirable that it be at least as long as the slabs being cast and rolled and better yet that the furnace-like structure be at least 125 percent as long as the slabs being cast. Note that the rate of the caster is about 10 to 12 feet per minute. Thus, the 150 foot long slab is cast in 12 to 15 minutes. By making the furnace longer than the slab, the temperature is not only maintained, but in this way, the difference in temperature between the head and tail is minimized and the heat is more equally distributed across and through the slab. The temperature of the slab out of the caster is about 2200° F. The temperature of the slab at the first pass of the rolling mill should be 1850° F. and preferably 1950° F.

Figure 2:
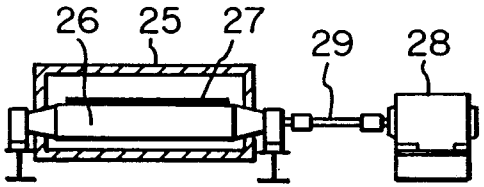
FIG. 2 is a section through the insulated run-out table taken along line II—II in FIG. 1.

Referring now to FIG. 2, there is illustrated insulated run-out table or furnace-like structure 16. The furnace-like structure comprises an insulated enclosure 25 surrounding the rollers 26 positioned therein for supporting the slab 27. The rollers are driven by motors 28 and shafts 29 positioned to one side of the furnace. It is essential that the rollers be individually controllable or controllable in groups so that a slab may be accelerated to the rolling mill suck-in speed without dragging over the rollers. However, as soon as the tail of the slab being sucked into the mill passes the rollers, the motors must slow down again to the casting speed. The capability of accelerating the slab toward the rolling mill has the additional advantage of moving the slab through the unprotected space between the end of the insulated run-out table and the bite of the first stand thereby minimizing temperature loss.

The control circuitry for the motors driving the rollers on the run-out table is not complicated. It is necessary that sensors be placed at most rollers to detect a slab resting thereon. Known detectors are adequate. The control circuitry must match the tangential roller speed at the casting speed immediately after the tail of the slab passes. It should remain at that speed until the next signal commanding acceleration to suck-in speed. The first several rollers on the run-out table should always be matched at the casting speed. The sensors can also be used to lock-off heating means over the rollers if no slab is resting thereon. Tracking the tail end of the slab through a process controller is equivalent known technology and can also be employed, thereby eliminating all the sensors.

The interior of the insulation over the rollers may preferably be of a reflective material to reduce heat loss and redistribute heat across the slab. Electrical heating elements or other means for introducing heat (for example radiation tubes) may be positioned over the rollers. The heating elements or radiation tubes should be distributed away from the casting end of the furnace so that they may be used to add heat to the slab at the end furthest from the caster. In this way the tail to head temperature distribution of the slabs can be minimized. Of course, the heating elements or radiation tubes should be controllable on and off so that they are not introducing heat when no slab is therebeneath.

A certain amount of cooling of the slabs must, of necessity, take place through the contact with the rollers, although disc rollers can be employed. Moreover, the rollers must be allowed to cool through the bearings thereof which are extended out of the furnace. It may be desirable that the rollers be made of a high temperature metal such as stainless steel.

It may be desirable to purge or flush the interior of the insulated run-out table with an inert or reducing atmosphere to reduce the formation of scale upon the slabs therein. Of course, it will be understood that conventional descaling apparatus may be employed.

According to a preferred embodiment of this invention, the slab is rolled to strip in a hot reversing mill. Upstream and downstream coiling furnaces 17 and 20 are then provided. The coiling furnaces may include burners to maintain an appropriate temperature. This temperature is required both for the workpiece being coiled and decoiled and for the coiling mandrel, if used, which must be at temperature near that of the incoming steel to prevent thermal shock. The details of the construction of the coiling furnace are known and form no part of this invention. Coiling furnaces have been described, for example, in U.S. Pat. Nos. 2,658,741; 4,384,468; 4,430,870; and British Specifications Nos. 918,005 and 652,772.

A four high reversing mill 19 is arranged downstream of coiling furnace 17 for receiving the slab. Beyond the reversing mill is another coiling furnace 20. The distance between the mill and the coiling furnaces on each side is approximately 23 feet.

Following the downstream coiling furnace 20 is run-out table 22 over which nozzles are positioned for spraying cooling fluid upon the strip to lower its temperature to the desired coiling temperature. A guide table 18 is associated with coiling furnace 17, and a guide table 21 is associated with coiling furnace 20. The guide tables direct the metal to the coiling furnaces during rolling in mill 19. Downcoiler 24 receives the finished strip although shears may be alternately employed where a sheet product rather than a coiled hot band is required.

Since the cast slab thickness is relatively small (on the order of 1.5 inches) in comparison to standard slabs (8–10 inches), the productivity in terms of tons/hr. is also small. For this reason a single hot reversing mill can presently handle the projected tonnage. It will be recognized that additional rolling stands can be employed upstream and/or downstream of the downstream coiler 20 depending upon the tonnage capability of the caster or the finished product needs. The coiling furnaces maintain the necessary heat so that an acceptable temperature drop is maintained during the various passes.

A computer simulation of a seven-pass cycle on a single hot reversing mill for reducing a low carbon steel slab 1.5 inches by 50 inches by 157 feet to a 20 ton coil (800 PIW) 0.1 inch thick may be summarized in the following Table 1:

TABLE 1

Rolling Schedule

| Pass | Exit Gauge (inches) | % Red. | Entry Temp. °F. | Exit Temp. °F. | Mill Speed (FPM) Thread | Mill Speed (FPM) Roll | Roll time (sec.) | Delay time (sec.) | Elapse Time (sec.) |
|---|---|---|---|---|---|---|---|---|---|
| FCE | 1.50 | 0 | 1900 | 1900 | 0.0 | 0.0 | 0.0 | 0.0 | 0.0 |
| 1 | .870 | 42 | 1862 | 1873 | 500.0 | 550.0 | 30.73 | 5 | 35.73 |
| 2 | .530 | 39.1 | 1851 | 1859 | 500.0 | 650.0 | 43.16 | 5 | 83.89 |
| 3 | .333 | 37.2 | 1830 | 1835 | 500.0 | 750.0 | 59.48 | 5 | 148.37 |
| 4 | .220 | 33.9 | 1801 | 1803 | 500.0 | 950.0 | 71.70 | 5 | 225.06 |
| 5 | .158 | 28.2 | 1767 | 1764 | 500.0 | 1200.0 | 79.78 | 5 | 309.84 |
| 6 | .120 | 24.1 | 1729 | 1724 | 500.0 | 1500.0 | 84.91 | 5 | 399.76 |
| 7 | .100 | 16.7 | 1690 | 1672 | 500.0 | 1500.0 | 94.23 | 0.0 | 493.98 |

The 494 seconds for rolling compare quite favorably with the time to cast the slab, namely 785 seconds at 12 feet per minute. In other words, there is more than adequate time to roll a slab into a coil within the casting time for the slab.

An aspect of this invention is that the columnar grain structure of the continuously cast slab is at least partially broken down prior to the first coiling downstream of the reversing mill. While it is not expected that the grain structure will be completely equiaxed after the first pass, at the temperature of the first pass, and with a draft of about 50 percent (combines for rapid recrystallization), the breakdown of the columnar structure will be sufficient to permit coiling without damage to the hot strip.

Having thus defined the invention in the particularity and detail as required by the patent laws, what is desired protected by letters patent is set forth in the following claims.

I claim:

1. A method of casting and rolling strip and/or sheet in line comprising the sequential steps of:

(a) continuously casting a continuous steel slab less than about 1.5 inches thick which naturally has a columnar grain structure in a caster;

(b) passing a leading end of said continuous slab onto an insulated run-out table spaced from said caster to maintain the temperature and minimize the heat loss from the forward section of said continuous slab and to permit equalization of temperature within the forward section of said continuous slab;

(c) cutting the forward section from said continuous slab to form an individual slab by a cutter located between said caster and said run-out table;

(d) passing the individual slab directly to a hot reversing mill having upstream and downstream coiling furnaces such that the individual slab first passes the hot reversing mill and is subject to an initial reduction in thickness sufficient to break up the columnar structure prior to being coiled as a strip in a coiling furnace;

(e) passing the strip back and forth through said hot reversing mill between said upstream coiling furnace and said downstream coiling furnace to produce sheet or strip having an equiaxed grain structure; and (f) concurrently with step (e) repeating steps (a) through (c) to provide another individual slab for rolling, whereby the casting speed is coordinated with the rolling speed to provide a substantially uninterrupted method of casting and rolling.

2. The method according to claim 1 wherein the slabs are cut to a length in excess of 100 feet.

3. The method according to claim 1 wherein the length of said insulated run-out table is at least 100 feet.

4. The method according to claim 1 wherein the length of said run-out table is at least 125 percent of the length of said individual slab.

5. The method according to claim 1 wherein the first pass through said hot reversing mill reduces the thickness of the individual slab by approximately 50 percent.

6. The method according to claim 1 wherein said forward section of said continuous slab is cut from said continuous slab with a flying shear to form an individual slab.

7. The method according to claim 1 including continuously flushing said run-out table with an inert or reducing gas.

8. The method according to claim 1 including introducing heat to the slab at the discharge end of the insulated run-out table.

9. The method according to claim 1 wherein said insulated run-out table has individually controllable driven rollers for supporting said forward section of said continuous slab and an individual slab after it is cut from said forward end of said continuous slab and controlling said rollers to accelerate the movement of said individual slab into said hot reversing mill at the time of suck-in and to slow said rollers to the speed of the said forward section of said continuous slab as soon as the tail of the preceding individual slab passes a roller.

10. The method according to claim 1 wherein the processing rate capability of said hot reversing mill is greater than the processing rate of said continuous casting.

* * * * *